United States Patent [19]

Keritsis et al.

[11] Patent Number: 4,674,519

[45] Date of Patent: Jun. 23, 1987

[54] COHESIVE TOBACCO COMPOSITION

[75] Inventors: Gus D. Keritsis, Richmond; Donald B. Knudson, Jr., Chester; Jerome S. Osmalov; Robert B. Seligman, both of Richmond, all of Va.

[73] Assignee: Philip Morris Incorporated, New York, N.Y.

[21] Appl. No.: 868,183

[22] Filed: May 21, 1986

Related U.S. Application Data

[63] Continuation of Ser. No. 613,935, May 25, 1984, abandoned.

[51] Int. Cl.[4] ..... A24B 3/14; A24B 15/00

[52] U.S. Cl. ..... 131/355; 131/353; 131/372

[58] Field of Search ..... 131/353, 355, 358, 370, 131/372; 613/935

[56] References Cited

U.S. PATENT DOCUMENTS

| | | | |
|---|---|---|---|
| 3,043,723 | 7/1962 | Cleverdon | 131/353 |
| 3,353,541 | 11/1967 | Hind | 131/17 |
| 3,386,449 | 6/1968 | Hind | 131/140 |
| 3,411,515 | 11/1960 | Hind et al. | 131/370 |
| 3,420,241 | 1/1969 | Hind | 131/140 |
| 3,464,422 | 9/1969 | Light et al. | 131/353 |
| 3,613,693 | 10/1971 | Monte | 131/370 |
| 3,746,012 | 7/1973 | Deszyck | 131/370 |
| 3,760,815 | 9/1973 | Deszyck | 131/140 |
| 3,795,250 | 6/1974 | Halter | 131/355 |
| 3,931,824 | 1/1976 | Miano et al. | 131/359 |
| 4,325,391 | 4/1982 | Schmidt | 131/372 |

FOREIGN PATENT DOCUMENTS

| | | | |
|---|---|---|---|
| 656164 | 1/1963 | Canada | 131/352 |

*Primary Examiner*—Ferris H. Lander

*Attorney, Agent, or Firm*—Jeffrey H. Ingerman

[57] ABSTRACT

A process for making a cohesive tobacco composition in which tobacco pectins within the tobacco itself serve as the binder by contacting dry tobacco particles with a solution, which contains an agent to destroy the alkaline earth metal cross-links of the tobacco pectins, under a high shear condition. A reconstituted tobacco sheet is made by forming the resulting mixture into a sheet and drying. In one embodiment ammonia and tobacco volatiles contained in vapors from the sheet drying step are recovered and recycled into the solution.

9 Claims, No Drawings

COHESIVE TOBACCO COMPOSITION

This is a continuation of application Ser. No. 613,935, filed May 25, 1984 entitled Cohesive Tobacco Composition.

BACKGROUND

The present invention relates generally to tobacco products and more particularly to an improved cohesive tobacco composition in which tobacco pectins within the tobacco itself serve as the binder, a process for making the composition, and the production of tobacco sheet from such composition.

During the production and processing of tobacco products, including aging, blending, sheet forming, cutting, drying, cooling, screening, shaping and packaging, considerable amounts of tobacco fines, dust, stems, and other small tobacco plant parts are produced. It is known that such small tobacco plant parts can be combined with a binder to form a coherent sheet, which resembles leaf tobacco and which is commonly referred to as reconstituted tobacco.

It is also known to treat the small tobacoo plant parts to release tobacco pectins from within the tobacco itself and to use such pectins as the binder. Such processes are taught by U.S. Pat. Nos. 3,353,541 and 3,420,241 to Hind and Seligman, U.S. Pat. No. 3,386,449 to Hind, and U.S. Pat. No. 3,760,815 to Deszyck, the disclosures of which are incorporated herein by reference. Unlike reconstituted tobacco made with non-tobacco derived binders, the reconstituted tobacco which is obtained from such pectin release processes need not contain any added cellulose or proteinaceous material which is foreign to tobacco, since the binder which is employed may be derived solely from tobacco, and may be produced in such a manner that it contains no materials other than those which naturally occur in tobacco. Thus, reconstituted tobacco produced in accordance with these processes can be so formulated as to be similar to natural tobacco in physical properties and chemical composition.

In the '541, '241 and '449 patents, diammonium acid phosphate or ammonium orthophosphate, is employed to treat the tobacco plant parts to destroy the alkaline earth metal cross-links of the tobacco pectins. The mechanism of the process involves four distinct steps: (1) the penetration of the tobacco material by the cross-link destruction agents; (2) the destruction of the alkaline earth metal cross-links and the release of the tobacco pectins; (3) the solubilization and migration of the resulting tobacco pectins from the interstices of the tobacco material; and (4) the depositing of the released tobacco pectins on the surface of the treated plant parts.

The first step of penetration of the tobacco material by the cross-link destruction agent begins upon contact of the tobacco material with the destruction agent in an aqueous mixture. Considering a single tobacco particle, the agent in aqueous form soaks into and permeates the particle over some period of time which may depend on such factors as the temperature of the mixture and the size, shape, surface area and porosity of the particles. Considering a large quantity of dry tobacco particles to be combined with an aqueous solution of pectin release agent, the time required to complete this step is increased by the mixing time required to effect contact of essentially every individual tobacco particle with the solution. Essentially complete mixing is highly desirable, for if not achieved, the result is an unacceptable sheet material containing lumps of dry tobacco. Reconstituted tobacco containing such lumps exhibit lower tensile strength and inferior appearance.

Similarly, if one begins with a mixture of dry tobacco particles and dry cross-link destruction agent to be combined with an aqueous solution to initiate the permeation, the mixing time must be sufficient to accommodate the additional time involved in dissolving the dry cross-link destruction agent into solution prior to permeation of the tobacco particles thereby.

The second step, which is release of the tobacco pectins by destruction of the alkaline earth metal cross-links, can be considered to occur somewhat concurrently with the first. As the agent permeates portions of the tobacco particles, destruction of the cross-links begins in those permeated portions.

The third step, which is solubilization of the resulting tobacco pectins and migration thereof from the interstices of the tobacco particles, involves a migration of the pectins in opposite directions to the directions of migration or permeation of the first step and thus must occur over some time period subsequent to the first step.

The fourth step, which is depositing the released tobacco pectins on the surface of the treated tobacco particles, can be considered to occur somewhat concurrently with the third. As the tobacco pectin migrates out of a tobacco particle, it may deposit onto the particle surface or dissolve into the solution and be deposited onto other particles.

In the process according to the '815 patent, ammonium salts of organic acids are used as the cross-link destruction agent. However, the steps of the mechanism are essentially the same as described above.

Under the conditions of the '541 process such as temperature, solids content, pH and mixture proportions, agitating or stirring of the mixture is taught therein as required for about one minute to one day. Under the conditions of the '815 process one-half to twenty-four hours is required. For economic reasons, it is desirable to reduce the time of agitation to a minimum, however, sufficient time must be allowed for the steps of the process to occur.

During long agitation times, conditions such as temperature and pH may change, thus means must be provided for monitoring and controlling these conditions. Moreover, long agitation times may increase viscosity to unacceptable levels such that the composition may not be cast, sprayed, coated, extruded or otherwise used in the manufacture of a tobacco product. Accordingly, the viscosity of the composition must be reduced to an acceptable value prior to its utilization. Typically, viscosity reduction is accomplished by dilution. However, such dilution increases the drying load and greatly impacts the economics of the process. In the '241 patent viscosity is kept at acceptable values by dilution with water prior to agitation. Water to a certain extent is required in any slurry making process, however, the less water used, and therefore the higher solids content of the resulting composition, the lower the drying load and the more favorable the economics of the process. As a result of the dilution factor, the slurry solids content of the process of the '241 patent are in the range of about 5% to 10%. A high solids content, greater than about 14 percent, is desirable. Also, with long agitation times mixing and storage vats may become necessary. The employment of such equipment adds significantly to the capital, maintenance and operating costs of the process.

In one known method of producing a cohesive tobacco composition as described in U.S. Pat. No. 4,325,391, incorporated herein by reference, tobacco material and an aqueous adhesive material are first contacted together and mixed within a high intensity mixer. In the '391 process, mixing times of an order of magnitude less than one minute and slurry solids content of about 22% are achieved. In such a quick mixing process, insufficient time elapses for the tobacco material to be thoroughly permeated by the aqueous adhesive material. In processes such as the '391 process wherein an adhesive is added to rather than produced within the mixture, this is not only an acceptable result but also a desirable one because permeation is not required since only an application of the adhesive to the surface of the tobacco material is necessary for binding the tobacco particles together in the formation of the tobacco sheet or other tobacco product. Moreover, as taught in the '391 patent, permeation is undesirable in such an adhesive additive process because subsequently greater drying capacity is required to dry the tobacco sheet or other tobacco product to an acceptable moisture content and thereby effect the adherence of the tobacco particles to one another. Indeed, the objective of the '391 patent is to effect sheet formation prior to complete moisture permeation and equilibrium of the tobacco particle.

Conversely, in processes for producing a cohesive tobacco composition whereby the tobacco pectin is released from the tobacco particles and used as the adhesive, permeation of the cross-link destruction agent is absolutely essential to effect release of the tobacco pectin adhesive. Moreover, as taught in the '541 patent, heretofore a period of one minute to one day of agitation and mixing was required for this to occur.

Accordingly, there is a need in the art for a process of making a cohesive tobacco composition and a reconstituted tobacco which has the advantages of using natural adhesive released from the tobacco itself, which yields a composition with increased solids content and acceptable viscosity and which may be accomplished quickly enough to avoid the expense of mixing tubs and holding tanks and the like.

SUMMARY OF THE INVENTION

The present invention alleviates to a great extent the disadvantages of the prior art by providing a method for making a cohesive tobacco composition with desirable viscosity and solids properties for use in making a reconstituted tobacco or other tobacco products by contacting dry tobacco plant particles with an aqueous solution containing a cross-link destruction agent under high shear conditions. Employing the present invention, the required mixing time for the cohesive tobacco composition making processes of the type employing a pectin release mechanism is reduced to an order of magnitude less than that achievable in the prior art while solids content in the composition is increased and viscosity is maintained at an acceptable level.

In Example 16 of the '241 and '541 patents, a Cowles high shear mixer is used for agitating the composition. However, the Cowles mixer is operated at low speed, thus a high shear condition was never reached. Consequently, mixing was required for one hour although a minimum time of 15 minutes was stated as sufficient.

In one embodiment of the present invention, tobacco particles are fed into one inlet of a high shear mixer while an aqueous solution of a pectin release agent and of other ingredients is fed into another inlet. The tobacco particles and the aqueous solution are mixed together and exit from the mixer in a period of time significantly less than one minute and are deposited onto a smooth belt and dried.

In another embodiment, a mixture of tobacco particles and pectin release agent is fed into one inlet of a high shear mixture and an aqueous solution of other ingredients is fed into another inlet. The mixture of tobacco and agent is low enough in moisture content such that it is free flowing and that the pectin release agent remains inactive and no significant cross link destruction occurs. The pectin release agent becomes active upon dissolving into the aqueous solution. The tobacco particles and the solution are mixed together, exit from the mixer and are cast onto a smooth belt and dried.

In a further feature, ammonia and tobacco volatiles are recovered from vapors driven off the sheet during drying.

It is an object of the invention to provide a cohesive tobacco composition having increased solids content for a given viscosity.

It is another object of the invention to provide a method of making a tobacco composition wherein natural tobacco pectins are released from tobacco particles to bind the particles together in the composition when dried.

It is another object of the invention to provide such a method having significantly reduced mixing times.

It is yet another object of the invention to provide a method yielding the foregoing advantages and which is more economical than prior methods.

It is still another object of the invention is to provide a method yielding the foregoing advantages and in which dry tobacco particles and an aqueous solution containing the cross-link destruction agent are contacted together within a high shear mixer.

It is another object of the invention to provide a method yielding the foregoing advantages and in which dry tobacco particles mixed with a dry cross-link destruction agent and an aqueous solution are contacted together within a high shear mixer.

It is a further object of the invention to provide a method yielding the foregoing advantages and which utilizes an ammonium or alkali earth metal orthophosphate as a cross-link destruction agent for releasing the tobacco pectins.

It is yet a further object of the invention to provide a method yielding the foregoing advangages and which utilizes ammonium salts of carboxylic acids or ammonium hydroxide and a carboxylic acid as the cross-link destruction agent.

It is another object of the invention to provide a method yielding the foregoing advantages and in which ammonia as well as tobacco volatiles are recovered during the drying of the sheet and recycled to the aqueous solution.

It is still a further object of the invention to provide a method of making tobacco sheet from the tobacco composition.

Other objects and advantages of the present invention will be readily apparent from the following description which illustrates the preferred embodiments of the invention.

DETAILED DESCRIPTION OF THE PREFERRED EMBODIMENTS

A first preferred embodiment of the present invention involves the mixing of tobacco particles with an aqueous solution of pectin release agent under high sheer conditions for a period of time less than one minute to prepare a tobacco composition for making tobacco sheet.

The tobacco particles may be fines, dust, laminae, stems or other tobacco particles or mixtures thereof. The tobacco particles may be from Burley, Bright, Oriental or other types of tobacco or mixtures thereof. Generally, the particles should be small enough for the steps of permeation, earth metal cross-link destruction, pectin release and deposition to be sufficiently accomplished to enable adequate binding in the resulting sheet in a process employing a short mixing time. Preferably, the particles are small enough to pass through a screen having apertures of about 14 mesh although smaller or larger particles may be used. As particle size increases, higher temperature may be required to release sufficient pectin.

The aqueous solution includes water and a cross-link destruction agent. When an ammonium or alkali metal orthophosphate such as diammonium monohydrogen orthophosphate (DAP) is used as the cross-link destruction agent, as in the '541 patent, the ranges of proportion of solution ingredients as disclosed in the '541 process is preferred. Namely, a preferred concentration of DAP in the aqueous solution is in the range of about 0.5 to about 5.0 percent by weight. In determining the rates of feed of the aqueous solution and the dry tobacco particles into the mixer, the amount of DAP should preferably be from about 0.01 to about 0.5 part by weight per part of tobacco being contacted in the mixer.

The temperature during the mixing may vary between room temperature and about 190° F. or higher depending on the type of tobacco being treated. Temperatures as high as 250° F. may be used provided that boiling of the mixture is preferably avoided. Even higher temperatures could be used as long as the tobacco is not damaged. The pH of the mixture is preferably maintained at a value of about 7.1 to about 10.0 which may be accomplished by the addition of a pH control agent such as ammonia to the solution.

Other ingredients may be added. For example, as a preservative in the finished sheet, sorbic acid, sodium benzoate, sodium propionate or others, may be added to result in a content of about 0.09% to about 0.12% by weight in the dried sheet. Also, color control agents including pigments or bleaching agents such as peroxide, calcium phosphate or magnesium phosphate may be added to the solution to lighten or darken the color of the resulting sheet as desired. A humectant, such as glycerin, triethylene glycol, propylene glycol, butanediol, sorbitrol, glucose, fructose, dextrose or others, may be present if desired at about 1 to 15 weight percent of the final sheet weight after drying.

The optimum proportions of ingredients, pH and temperature will vary somewhat depending upon the particular blend of tobacco particles used. For example, when bright tobacco is used in the process, a somewhat lower temperature is preferred than when using burley tobacco. Stems may require a somewhat higher temperature than dust or filler.

The dry tobacco and the solution are fed through separate inlets into a high shear mixer. The mixer described in the '391 patent is suitable for this purpose. The shear rates experienced at a given location in such a mixer vary depending upon the local conditions. For example, where the tip of the mixer blade passes the screen with about a 320 millimeter ($\frac{1}{8}$") clearance, the instantaneous shear rate is about 31000 $sec^{-1}$ at a rotor speed of 3500 rpm and blade tip speed of about 49 meters per second (160 feet per second) and about 47,000 $sec^{-1}$ at 5200 rpm and blade tip speed of 70 meters per second (230 feet per second). For the mixer configuration of the '391 patent, rotor speeds of greater than 3500 rpm are preferred and a speed of about 5200 rpm is more preferable. Of course, required rotor speed may vary depending upon the physical properties of the mixture therein such as particle size and viscosity. Preferably, the mixer size and the feed rates are designed such that the residence time of the mixture in the mixer is minimized while achieving enough throughout to supply sufficient material directly to the sheet making apparatus such as apparatus of the type described in the '391 patent.

The mixture exits the mixer through a screen having apertures of preferably about 0.25 to about 1.5 millimeters and is deposited into a head box and cast, or otherwise coated, at a thickness of preferably about 0.5 millimeters to about 1.0 millimeters onto a moving smooth surface belt. The cast sheet is then dried to an OV of about 14 percent and removed from the belt. OV, oven volatiles, is defined as those volatiles in tobacco that are evolved by treatment in a forced draft oven at 100° C. for 3 hours.

During the drying operation, significant quantities of ammonia evaporate from the sheet. Therefore, it is preferable to use a hooded dryer to capture and exhaust the evaporating vapor from the sheet making line. The ammonia may be recovered from the exhaust vapor by contacting the vapor with an acid solution such as a solution of phosphoric acid or citric acid, or the like and preferably made with deionized water. In the case of phosphoric acid, the reaction of ammonia with phosphates will result in a mixture of ammonium phosphates including hypophosphate, orthophosphate, orthodihydrogen phosphate and ortho-monohydrogen phosphate. These ammonium phosphates may be used as a source of pectin release agent in preparing the aqueous solution as described above resulting in a cost savings for the overall process. Moreover, tobacco volatiles present in the vapor are also recovered with the ammonia and recirculated back into the process.

In a second preferred embodiment of the invention ammonium salts of carboxylic acids, or ammonium hydroxide and a carboxylic acid are employed as the cross-link destruction agent. Conditions such as temperature, pH and ingredient proportions of the process are preferably the same as taught in the '815 process except that the tobacco and the aqueous solution containing the destruction agent are first contacted in a high shear mixer. The apparatus used in the process is similar to that described in the previous embodiments.

In a third preferred embodiment the tobacco particles are mixed with an aqueous solution to form a slurry prior to introduction into the mixer. The aqueous solution is essentially free from pectin release agent but may contain other additives as mentioned in regard to the first embodiment. The water content of the aqueous solution may be decreased accordingly to avoid an unduly thin resulting composition exiting from the mixer.

In a fourth preferred embodiment of the invention, the cross-link destruction agent is combined with the tobacco particles prior to being introduced into the mixer. For ease of handling and feeding, the tobacco and destruction agent are preferably low enough in moisture to be granular and free flowing. Additionally, the moisture content should be low enough such that no significant reaction of the cross-link destruction agent with the tobacco occurs prior to introduction into the mixer. Tobacco and agent having a moisture content of less than about 18% OV has been used successfully although higher moisture contents may be used. For example, in the case where DAP is used as the cross-link destruction agent, the proportion of DAP to tobacco is the same as in the previously described embodiment. The DAP does not become active and permeate the tobacco particles to any significant degree until the DAP-tobacco mixture is contacted with the aqueous solution of the balance of the ingredients and the DAP dissolves into the solution and is thereafter absorbed by the tobacco particles. The other features of the process of this embodiment are the same as in the previously described embodiment. As a further feature of this embodiment, some or all of the other ingredients, such as sorbic acid and the like as mentioned regarding the first embodiment, may also be added in dy form to the tobacco prior to being introduced into the mixer.

The cohesive tobacco composition product formed by the process yields higher solids content at a given viscosity than was obtained heretofore.

In a sheet forming process where the slurry is deposited onto a moving surface from a headbox through an aperture formed between the belt and the downstream side of the box, for typical sheet thicknesses, the maximum slurry viscosity is about 2000 centipoise. Viscosity values herein are as measured by a Fann viscometer at 75° F. using Rotor #3, Bob #1 and a shear rate of 113 $sec^{-1}$ (or 300 RPM). The cohesive tobacco product of the present invention has an observed viscosity lower than the aforementioned maximum in that satisfactory casting with such an apparatus was achieved. Moreover, the solids content of the product was as high as 26 percent as illustrated by Example 9 hereinbelow, well over the maximum achievable solids content of about 12 percent of previous products employing a released tobacco pectin binder.

The following examples are illustrative:

EXAMPLE 1

A 2.5 percent solids solution of 7.5 parts diammonium orthophosphate, 4.6 parts triethylene glycol, 0.25 parts potassium sorbate, 2 parts corn syrup, and 15 parts aqueous ammonia (29.4 percent $NH_3$) in 71 degrees Celsius (160 degrees Fahrenheit) water was prepared. Simultaneously, this solution and tobacco plant parts which had been passed through a 14 mesh screen were metered at the combined rate of 734 kilograms per hour and at the ratio of 23.3 kilograms of tobacco per 100 kilograms of solution into a Fitzmill model No. DKAS06 high shear mixer having a mixing volume of 2.26 liters (138 $inches^3$) and a blade speed of about 5200 revolutions per minute.

The solution and the tobacco were metered into the mixer through corresponding separate inlets and first contacted one another within the mixer to form a calculated 21% solids content slurry. The average residence time of the ingredients within the mixer was 11.2 seconds. The slurry exited the mixer through a screen having 1.0 millimeter (40 mil) openings and was cast at 0.64 millimeter (25 mil) wet thickness onto a continuous stainless steel belt moving at 30 centimeters per second (60 feet per minute) and dried to about 17 percent OV. The formed sheet was very streaky in appearanced, had a tensile strength of 16 kilograms per meter (0.40 kilograms per inch), a sheet weight of 137 grams per $meter^2$ (12.7 grams per $foot^2$) and an equilibrated OV of 13 percent.

EXAMPLE 2

Example 1 was repeated except that the ingredients were metered into the mixer at a combined rate of 883 kilograms per hour, the average residence time of the ingredients within the mixer was 9.30 seconds and the sheet was cast at a 0.76 millimeter (30 mil) wet thickness. The properties of formed sheet differed significantly from those of Example 1 only in that the sheet was less streaky and more acceptable in appearance.

EXAMPLE 3

A 2.3 percent solids solution of 4 parts triethylene glycol, 0.25 parts potassium sorbate, 2 parts corn syrup and 13.5 parts aqueous ammonia (29.4 percent $NH_3$) in 71 degrees Celsius (160 degrees Fahrenheit) water was prepared. One hundred parts tobacco which had been passed through an 80 mesh screen was mixed with 7.5 parts diammonium orthophosphate. Simultaneously, the solution and the mixture of tobacco and agent were metered at a combined rate of 734 kilograms per hour and a ratio of 25.7 kilograms of dry mixture to 100 kilograms of solution into the mixer of Example 1. As in the prior examples, the solution and the mixture were metered into the mixer through corresponding separate inlets and first contacted one another within the mixer to form a calculated 22% solids content slurry. The average residence time of the ingredients within the mixer was 11.2 seconds.

The slurry exited the mixer through a screen having 1 millimeter (40 mil) openings and was cast at 0.64 millimeters (25 mil) wet sheet thickness onto a continuous stainless steel belt moving 30 centimeters per second (60 feet per minute) and dried to about 17 percent OV. The formed sheet had a number of gelled particles, although otherwise it had an acceptable appearanace, had a tensile strength of 17 kilograms per meter (0.42 kilograms per inch), a sheet weight of 110 grams per $meter^2$ (9.8 grams per $foot^2$), a breaking elongation of 3.2 percent and an equilibrated OV of 13.9 percent.

EXAMPLE 4

Example 3 was repeated except that the slurry exited the mixer through a screen having 0.69 millimeter (27 mil) openings. The formed sheet had practically no gelled particles, had a tensile strength of 20 kilograms per meter (0.51 kilograms per inch) a sheet weight of 115 grams per $meter^2$ (10.7 grams per $foot^2$), a breaking elongation of 4.8 percent and an equilibrated OV of 14.1 percent.

EXAMPLE 5

Example 4 was repeated except that the slurry was cast at a thickness of 0.76 millimeter (30 mils). Again, the formed sheet had practically no gelled particles, had a tensile strength of 34 kilograms per meter (0.86 kilograms per inch), a sheet weight of 165 grams per $meter^2$ (15.3 grams per $foot^2$), a breaking elongation of 5.5 percent and an equilibrated OV of 13.7 percent.

EXAMPLE 6

A 4.1 percent solids solution of the proportion of ingredients of Example 1 in 82 degrees Celsius (180 degrees Fahrenheit) water was prepared. Simultaneously, this solution and tobacco plant parts which has been passed through a 60 mesh screen were metered at the combined rate of 926 kilograms per hour and at the ratio of 22.4 kilograms of tobacco per 100 kilograms of solution into the mixer of Example 1.

The solution and the tobacco were metered into the mixer through corresponding separate inlets and first contacted one another within the mixer to form slurry having a calculated 22 percent solids. The average residence time of the ingredients within the mixer was 8.4 seconds. The slurry exited the mixer through a screen having 0.69 millimeter (27 mil) openings and was cast at 0.62 millimeter (24 mil) wet thickness onto a continuous stainless steel belt moving at 38 centimeters per second (75 feet per minute) and dried to about 13.2 percent OV. The formed sheet was acceptable in appearance, had a tensile strength of 31 kilograms per inch (0.78 kilograms per inch), sheet weight of 130 grams per meter$^2$ (12 grams per foot$^2$), a breaking elongation of 4.6 percent and an equilibrated OV of 13.5 percent.

EXAMPLE 7

Under the conditions of the run of Example 6, except with a feed rate of 845 kilograms per hour, a slurry solids content of 19.2 percent, and an average residence time in the mixer of 9.2 seconds and a dried sheet OV of 13.9 percent, the formed sheet was acceptable in appearance, had a sheet weight of 98 grams per meter$^2$ (9.1 grams per foot$^2$), but unchanged values for equilibrium OV, tensile strength and breaking elongation.

EXAMPLE 8

The conditions of Example 7 were repeated except that tobacco dust which had been passed through a 14 mesh screen was used. The resulting sheet was acceptable in appearance, had an equilibrium OV of 17.2 percent, sheet weight of 98 grams per meter$^2$ (9.1 grams per foot$^2$), tensile strength of 19 kilograms per meter (0.48 kilograms per inch) and breaking elongation of 9.8 percent.

EXAMPLE 9

A 4 percent solution of the proportion of ingredients of Example 1 in 71 degrees Celsius (160 degrees Fahrenheit) water was prepared. Simultaneously, this solution and tobacco plant parts being factory dust which had been passed through a 60 mesh screen were metered at the combned rate of 764 kilograms per hour and at the ratio of 30 kilograms of tobacco per 100 kilograms of solution into the mixer of Example 1 in the manner of Example 1 to form a slurry having a calculated 26 percent solids content. The average residence time of the ingredients within the mixer was 10.6 seconds. The slurry exited the mixer through a screen having 1 millimeter openings and was cast at 0.64 millimeter (25 mil) wet thickness onto a continuous stainless steel belt moving at 31.8 centimeters per second (62.5 feet per minute) and dried to about 17 percent OV. The formed sheet was acceptable in appearance, had an equilibrium OV of 15.3 percent, a sheet weight of 121 grams per meter$^2$ (11.2 grams per foot$^2$), a tensile strength of 26 kilograms per meter (0.67 kilograms per inch) and a breaking elongation of 7.6 percent.

EXAMPLE 10

Example 9 was repeated except that the solution and tobacco dust were metered at the combined rate of 905 kilograms per hour and at the ratio of 26 kilograms of tobacco per 100 kilograms of solution to form a slurry having a calculated 24 percent solids content.

The average residence time of the ingredients within the mixer was 8.9 seconds. The formed sheet was acceptable in appearance, had an equilibrium OV of 15.4 percent, a sheet weight of 118 grams per meter$^2$ (11.0 grams per foot$^2$), a tensile strength of 24 kilograms per meter (0.62 kilograms per inch) and a breaking elongation of 7.6 percent.

EXAMPLE 11

A portion of the slurry exiting the mixer of Example 10 was aged for one hour at 60–71 degrees Celsius (140–160 degrees Fahrenheit) prior to casting. The formed sheet was acceptable in appearance, had an equilibrium OV of 15.1 percent, a sheet weight of 126 grams per meter$^2$ (11.7 grams per foot$^2$), a tensile strength of 25 kilograms per meter (0.63 kilograms per inch) and a breaking elongation of 6.9 percent.

EXAMPLE 12

Example 9 was repeated except that the tobacco included 70 percent dust and 30 percent stems, the solution and the tobacco parts were metered at the combined rate of 1000 kilograms per hour and at the ratio of 24 kilograms of tobacco per 100 kilograms of solution to form a slurry having a calculated 23 percent solids content. The average residence time of the ingredients within the mixer was 8.1 seconds. The slurry solids content was 19 percent. The formed sheet was acceptable in appearance, had an equilibrium OV of 15.5 percent, a sheet weight of 94 grams per meter$^2$ (8.7 grams per foot$^2$), a tensile strength of 23 kilograms per meter (0.59 kilograms per inch) and a breaking elongation of 6.6 percent.

EXAMPLE 13

A portion of the slurry exiting the mixer of Example 12 was aged for 45 minutes at 71 degrees Celsius (160 degrees Fahrenheit) prior to casting. The formed sheet was acceptable in appearance, had an equilibrium OV of 15.5 percent, a sheet weight of 139 grams per meter$^2$ (12.9 grams per foot$^2$), a tensile strength of 25 kilograms per meter (0.63 kilograms per inch) and a breaking elongation of 7.1 percent.

EXAMPLE 14

Example 9 was repeated except the solution was brought to a temperature of 88 degrees Celsius (190 degrees Fahrenheit) and tobacco dust which had been passed through a 14 mesh screen was used. The solution and dust were metered in at the combined rate of 1841 kilograms per hour and at the ratio of 24 kilograms of tobacco per 100 kilograms of solution to form a slurry of 22 percent solids (calculated). The average residence time of the ingredients within the mixer was 4.4 seconds. The slurry exited the mixer through a screen having 0.69 millimeter (27 mil) openings and was cast at a 0.65 millimeter (25 mil) wet thickness onto a continuous steel belt moving at 76 centimeters per second (150 feet per minute) and dried to about 190 percent OV. The formed sheet was acceptable in appearance, had an equilibrium OV of 15.5 percent, a sheet weight of 122 grams per meter$^2$ (11.3 grams per foot$^2$), a tensile strength of 19 kilograms per meter (0.47 kilograms per inch), a breaking elongation of 8.2 percent and a wet tensile strength of 4 kilograms per meter (0.1 kilograms per inch).

EXAMPLE 15

Example 14 was repeated except that 70 percent tobacco fines and 30 percent burley stem were used. The formed sheet was acceptable in appearance, had an equilibrium OV of 13.2 percent, a sheet weight of 126 grams per meter$^2$ (11.7 grams per foot$^2$), a tensile strength of 35 kilograms per meter (0.90 kilograms per inch), a breaking elongation of 6.4 percent and a wet tensile strength of 10 kilograms per meter (0.3 kilograms per inch).

The above description includes examples directed to the forming of reconstituted tobacco sheet; however, the invention is not limited thereto. The cohesive tobacco composition may be otherwise utilized by extruding or by application as a coating, or by spraying or otherwise in the formation of a tobacco product.

The above description is only illustrative of a number of preferred embodiments which achieve the objects, features and advantages of the present invention and it is not intended that the present invention be limited thereto. Any modification of the present invention which comes within the spirit and scope of the following claim is considered part of the present invention.

What is claimed as new and desired to be secured by Letters Patent of the United States is:

1. A process for making a cohesive tobacco composition having a solids content greater than about 14%, said process comprising:

contacting tobacco particles with an alkaline earth metal cross-link destruction agent and an aqueous solution under conditions of continuous high shear mixing for a duration of less than one minute, wherein said particles are maximally penetrated by said agent and tobacco pectins are released, said high shear mixing being effective without further aging or refining to produce a cohesive tobacco composition having the desired solids content greater than about 14% and having a viscosity suitable for casting.

2. A process according to claim 1, wherein said duration is about one-tenth of one minute.

3. A process according to claim 1, wherein the tobacco particles are small enough to pass through a 5 mesh screen.

4. A process according to claim 1, wherein said aqueous solution includes ammonia as a pH control agent.

5. A process according to claim 1, wherein the temperature of said solution is from about 60° F. to about 250° F.

6. A process according to claim 5, wherein the temperature of said solution is from about 160° F. to about 190° F.

7. A process for making a cohesive tobacco sheet having a solids content greater than about 14% and a viscosity less than about 2000 centipoise, said process comprising the steps of:

a. contacting tobacco particles with an alkaline earth metal cross-link destruction agent and an aqueous solution under conditions of continuous high shear mixing for a duration of less than one minute, wherein said particles are maximally penetrated by said agent and tobacco pectins are released, said high shear treatment being effective without further aging or refining to produce a cohesive tobacco composition having the desired solids content greater than about 14% and having the desired viscosity less than about 2000 centipoise;

b. depositing said composition onto a surface to form a sheet; and c. drying said sheet.

8. The process according to claim 7, further comprising extruding said composition through a screen having apertures of about 0.25 to 1.5 millimeters prior to said depositing step.

9. A process according to claim 7, further comprising the steps of:

contacting vapor evaporated from said sheet during the drying step with a solution of phosphoric acid thereby recovering ammonia and tobacco volatiles and forming a mixture including ammonia phosphates; and using said mixture to form said aqueous solution.

* * * * *

UNITED STATES PATENT AND TRADEMARK OFFICE

CERTIFICATE OF CORRECTION

PATENT NO. : 4,674,519

DATED : June 23, 1987

INVENTOR(S) : Gus D. Keritsis et al.

It is certified that error appears in the above-identified patent and that said Letters Patent is hereby corrected as shown below:

Column 4, line 36, "is" (second occurrence) should be deleted.

Column 7, line 26, "dy" should be -- dry --.

Column 8, line 5, "appearanced," should be --appearance, --.

Column 9, line 6 "has" should be -- had --;

line 22, "inch" should be -- meter --;

line 53, "combned" should be -- combined --.

Column 10, line 66, "190" should be -- 19 --.

Signed and Sealed this

Twenty-ninth Day of March, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,674,519

DATED : June 23, 1987

INVENTOR(S) : Gus D. Keritsis et al.

It is certified that error appears in the above-identified patent and that said Letters Patent is hereby corrected as shown below:

Column 7, line 37, "F." should be -- C. --.

Signed and Sealed this

Seventh Day of March, 1989

*Attest:*

DONALD J. QUIGG

*Attesting Officer*

*Commissioner of Patents and Trademarks*